US011131166B2

(12) United States Patent
Minty et al.

(10) Patent No.: US 11,131,166 B2
(45) Date of Patent: Sep. 28, 2021

(54) LANDING STRING RETAINER SYSTEM

(71) Applicant: Expro North Sea Limited, Aberdeenshire (GB)

(72) Inventors: Stephen George Minty, Agotnes (NO); Andrew Macdonald Carmichael, Aberdeen (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 15/519,339

(22) PCT Filed: Oct. 16, 2015

(86) PCT No.: PCT/GB2015/053081
§ 371 (c)(1),
(2) Date: Apr. 14, 2017

(87) PCT Pub. No.: WO2016/059425
PCT Pub. Date: Apr. 21, 2016

(65) Prior Publication Data

US 2017/0247985 A1 Aug. 31, 2017

(30) Foreign Application Priority Data

Oct. 16, 2014 (GB) ..... 1418377

(51) Int. Cl.

| | |
|---|---|
| ***E21B 19/10*** | (2006.01) |
| ***E21B 17/16*** | (2006.01) |
| ***E21B 41/00*** | (2006.01) |
| ***E21B 19/00*** | (2006.01) |
| ***E21B 23/01*** | (2006.01) |

(52) U.S. Cl.
CPC ..... *E21B 41/0021* (2013.01); *E21B 19/006* (2013.01); *E21B 19/10* (2013.01); *E21B 23/01* (2013.01)

(58) Field of Classification Search
None
See application file for complete search history.

(56) References Cited

U.S. PATENT DOCUMENTS 3,719,442 A * 3/1973 Schippers ..... D01D 10/0436 264/168
6,349,764 B1 2/2002 Adams et al.
(Continued)

FOREIGN PATENT DOCUMENTS

WO WO2011074984 A1 6/2011

*Primary Examiner* — Matthew Troutman
*Assistant Examiner* — Douglas S Wood
(74) *Attorney, Agent, or Firm* — Getz Balich LLC

(57) ABSTRACT

A retainer system, device and method are provided for retaining a severed pipe string such as a landing string suspended from a rig of a floating vessel or platform during a failure of a primary or secondary heave compensation system and prevent the severed pipe string from flying over the rig floor. The retainer system includes a retainer device including a housing mounted to a platform or vessel, the housing defining a through bore for receiving a pipe string suspended from the platform or vessel. A safety sleeve extends through the housing. A stop arrangement is mountable on the pipe string, to permit engagement between the safety sleeve and the stop arrangement in order to limit relative movement between the housing and the pipe string in order to retain a severed pipe string in an emergency situation.

17 Claims, 9 Drawing Sheets

(56) References Cited

U.S. PATENT DOCUMENTS

| | | | | |
|---|---|---|---|---|
| 6,695,064 | B2 * | 2/2004 | Dallas | E21B 19/00 166/382 |
| 7,287,598 | B2 * | 10/2007 | Adams | E21B 19/002 166/382 |
| 9,284,797 | B2 * | 3/2016 | Skinnes | E21B 19/006 |
| 9,328,570 | B2 * | 5/2016 | Sele | E21B 19/004 |
| 9,359,836 | B2 | 6/2016 | Liland et al. | |
| 2002/0092656 | A1 | 7/2002 | Ford et al. | |
| 2002/0100596 | A1 | 8/2002 | Nguyen et al. | |
| 2005/0189116 | A1 | 9/2005 | See | |
| 2013/0105168 | A1 | 5/2013 | Overland | |

* cited by examiner

LANDING STRING RETAINER SYSTEM

This application claims priority to PCT Patent Appln. No. PCT/GB2015/053081 filed Oct. 16, 2015, which claims priority to GB Patent Appln. No. 1418377.6 filed Oct. 16, 2014, which are herein incorporated by reference.

BACKGROUND OF THE INVENTION

1. Technical Field

The present invention relates to a retainer system for a pipe string such as a landing string and uses thereof in oil and gas operations. The present invention further relates to a compensation system for oil and gas operations.

2. Background Information

Pipe strings such as landing strings, drill strings and the like are used to operatively connect a subsea well to a floating platform or a vessel in order to perform workover, drilling, production or similar operations. The pipe string may be deployed within another larger diameter pipe such as is common with landing strings deployed within a marine riser which also extends from the subsea well to the floating platform.

For compensating for wave induced distance changes from the seabed to the floating platform, a heave compensation system is typically employed. Failure of a heave compensation system is a serious catastrophic incident that may have grave consequences for the personnel on the rig and the equipment. For instance, if the heave compensation system of a rig fails, the pipe string may be severed as a result of being subjected to excessive forces. In such situations, the severed upper part of the pipe string may eject through the rotary table of the rig high up over the rig floor with obvious risks to personnel and rig equipment.

To prevent such catastrophic events it has been suggested to furnish the rig with one or more secondary heave compensation systems. Examples of such secondary systems are described in WO2011/074984 and WO2013/137743.

WO2011/074984 describes a heave compensation system, referred to as a release module that connects a pipe string to a heave compensated top drive on a floating installation. The release module comprises two hydraulic cylinder units interconnected via a pipe clamp that form an extendable connection between the heave compensated top drive and the pipe string. Each hydraulic cylinder is in fluid communication to an accumulator unit via a hydraulic fluid circuit. The hydraulic fluid circuit comprises a safety valve that opens to allow draining the hydraulic fluid to the accumulator unit, when the pressure exceeds a pre-set limit.

WO2013/137743 describes a self-supported secondary heave compensation unit for a drill string comprising a cylinder/piston unit, an accumulator, and a drainage tank which is connected at one end to a primary heave compensation system and via a piston rod to the drill string. The cylinder/piston unit comprises a liquid at both sides of the piston which is positioned in the middle of the cylinder. A control valve is used to establish fluid communication between the cylinder and the gas containing accumulator when the load from the piston exceeds a predetermined level. A dump valve controls fluid communication between the cylinder and the drainage tank and is arranged to open to allow draining excess liquid.

Others have suggested the use of a so-called "weak link" in the landing string suspension system. Existing weak link systems, also referred to as weak link bails may employ a telescopic joint and an activator mechanism comprising a shear pin or fracture bolt which is set to activate and extend at a pre-set tensile load, in order to take off the tension load on the equipment deployed in a landing string. On such weak link system is described in U.S. Pat. No. 9,080,396 to Overland. Typically, if the heave compensators on the rig lock-up, this will put extra tension load on the weak link bail, and when a pre-set load is reached, the weak link bail is released and extends reducing the tensile loading on the landing string abruptly to zero. Thus, such weak link systems subject the landing string into compression, since there is nothing holding the landing string in tension once the weak link bail is activated. This often could cause buckling damage in the landing string.

Also, when using a combination of a landing string and a heavy flow head on top of the string, the use of a weak link bail as a safety device may result in bending of the landing string going through a rotary table on the drill floor, with subsequent risk of snapping off a connection at the drill floor, possibly causing serious damage to the landing string and release of hydrocarbons.

Thus, there remains a need for improved devices and systems that may prevent and or mitigate the catastrophic results of severed pipe strings such as landing strings employed in subsea wells.

SUMMARY OF THE INVENTION

An aspect of the present invention relates to a retainer system comprising: a retainer device comprising a housing mountable to a platform or vessel, the housing defining a through bore for receiving a pipe string; a safety sleeve extending through the housing; a stop arrangement mountable on the pipe string; wherein engagement between the safety sleeve and the stop arrangement limits relative movement between the housing and the pipe string.

In use, a pipe string comprising a stop arrangement may be deployed through the through bore of the housing of the retainer system. During normal operations, the pipe string may move freely in several directions through the through bore of the housing without the safety sleeve adversely affecting operations or the integrity of the pipe string. However, in emergency situations, the retainer system will limit the relative movement of the pipe string through the housing within a safe range that may prevent the pipe from being subjected to excessive tensile force thus preventing the severing of the pipe string. The retainer system may also be employed to hinder or prevent a severed pipe string from ejecting out of the housing. For example, if the pipe string is severed, the retainer system may prevent or slow down the severed pipe string from being ejected out of the retainer device by engaging the stop arrangement of the pipe string with the safety sleeve. Thus, the retainer device is adapted to slow down, or completely stop the pipe string from ejecting out of the retainer device.

The retainer system may be used with floating, jack-up or stationery rigs. The retainer system may be used, for example, with a mobile offshore drilling unit in conjunction with a subsea well such as semi-submersible drilling unit, a drill vessel, or a jack-up rig. The retainer system may also be used with a jack-up drilling rig used in conjunction with a surface well on a steel jacket. The retainer system may also be used with stationery drilling units on development fields. The retainer system may be used with single or multiple bore applications.

The retainer system may be used with a floating platform or vessel employing one or more heave compensation systems. For example, the retainer system may be deployed in such a manner so that the pipe string may be suspended from a heave compensation system associated with the floating platform or vessel. The heave compensation system may be a primary heave compensation system or may be a secondary heave compensation system. A primary heave compensation system as the term is used herein relates to a main heave compensation system of the floating platform or vessel. A secondary heave compensation system as the term is used herein refers to any heave compensation system other than the primary heave compensation system. As it should be understood by the skilled person in this art, the retainer system of the present invention is particularly advantageous with mobile offshore drilling units, however, the retainer system may also be used in conjunction with stationery drilling units or jack-up units.

In an emergency situation, the pipe string may be subjected to increased tensile forces that may subject the integrity of the pipe string at risk. One example of such an emergency situation may occur upon extreme weather conditions overcoming the normal operational limits of the primary and/or secondary heave compensation system of a floating platform or vessel. Another example of an emergency situation may arise upon a malfunction or failure of one or more of the heave compensation systems of a platform or a vessel. Yet another example of an emergency situation may arise because of a severed pipe string. A severed pipe string is not a common event, however, such an event may occur either in offshore as well as in land wells for a variety of reasons.

Therefore, the present invention retainer system may be advantageous in operational conditions that may subject the pipe string to excessive tension regardless of the root cause of the problem. For instance, in a severed pipe string incident, the retainer system may, via the safety sleeve and stop arrangement, at least partially absorb or completely absorb the kinetic energy of a severed upper portion of the pipe string trying to eject out of the housing of the retainer device.

The safety sleeve may engage the stop arrangement of the pipe string if the relative movement of the pipe string with the housing exceeds a predetermined safe limit. Alternatively or additionally, the retainer system may hinder or prevent a severed pipe string from ejecting out of the retainer system.

Another aspect of the present invention relates to a retainer device for a pipe string, the retainer device comprising: a housing mounted to a platform or vessel; the housing defining a through bore for receiving a pipe string; a safety sleeve extending within the housing, wherein the safety sleeve is adapted to engage a stop arrangement associated with the pipe string to limit the relative movement between the housing and the pipe string during operations.

Yet another aspect of the present invention relates to a pipe string comprising a stop arrangement associated with the pipe string, wherein the stop arrangement is adapted to engage a safety sleeve of a retainer device to arrest or slow down the movement of the pipe string during operations.

The retainer device may be mounted to any suitable structure of the rig of the platform or vessel. The retainer device may be installed above or below a rig floor. The retainer device may be installed below a rig floor as rig floor space is limited. The retainer device may be installed above or below a rotary table through bore or other similar through bore employed in rigs for deploying a pipe string therethrough. The retainer device may be secured to the rig so that the through bore of the retainer device may be positioned adjacent to and aligned with the through bore of the rotary table.

The housing of the retainer device may be of any suitable shape and size and may be constructed of any suitable material provided that it defines a sufficiently large through bore for the pipe string to be deployed freely therethrough and that it allows enough space for a safety sleeve to be mounted thereon. The housing may be made of or comprise a heavy, metal body in order to be capable to withstand impact from the pipe string when the stop arrangement of the pipe string engages the safety sleeve.

The housing may comprise a new structure or alternatively may comprise a retrofitted existing structure, such as for example, the housing of a diverter often found in existing rigs typically immediately below a rotary table. The diverter housing may be retrofitted by mounting a safety sleeve to the housing of the diverter. The safety sleeve may be mounted at a position where the safety sleeve does not interfere with the free movement of the pipe string during normal operations. Moreover, the safety sleeve may be positioned so that it may engage a corresponding stop arrangement of the pipe string to thereby limit the movement of the pipe string during an emergency situation. By limiting the relative movement between the pipe string and the housing, the integrity of the pipe string may be preserved. Alternatively or additionally, if the pipe string is severed due to excessive tensile forces overcoming the tensile failure limit of the pipe string, the safety sleeve engages the stop arrangement to hinder or prevent the severed pipe string from ejecting out of the through bore of the housing thus protecting the rig personnel and equipment.

The housing comprises a safety sleeve adapted to engage a stop arrangement member of a pipe string to limit the relative movement between the housing and the pipe string thus protecting the integrity of the pipe string. If the integrity of the pipe string is compromised and the pipe is severed the retainer system may inhibit or prevent a severed pipe string from ejecting out of the through bore of the housing.

The safety sleeve may be mounted to the housing so that at least a portion of the safety sleeve may extend within the housing. At least a portion of the safety sleeve may lie adjacent a portion of the pipe string extending through the through bore of the housing. Alternatively, the safety sleeve may be mounted in its entirety to and extending within the housing.

The safety sleeve may be an integral part of the housing.

The safety sleeve may be a separate member that it is mounted to the housing via one or more well-known methods. For instance, the safety sleeve may be fastened to the housing via one or more well-known fasteners, may be permanently fastened to the housing for example via welding or the like. The safety sleeve may be releasably fastened to the housing via one or more well-known methods. Providing a safety sleeve that it is fastened to the housing may allow for easier replacement of a used safety sleeve, retrofitting to existing systems or the like.

The safety sleeve may be, or comprise an insert adapted to be positioned within a corresponding pocket of the housing. The insert may be secured via releasable fasteners to the housing. Employing an insert and pocket design may also facilitate replacement of a used safety sleeve.

The safety sleeve may be of any suitable shape and size provided that, upon mounting of the safety sleeve to the housing, a small clearance is kept between the safety sleeve and the pipe string. The small clearance may be sealed using a sealing arrangement such as a dynamic sealing arrangement, without interfering with the free movement of the pipe string during normal operations.

The safety sleeve may comprise a cylindrical tubular body that may closely fit around the pipe string.

The safety sleeve may have a rim at one end thereof, for example at an upper end adapted for hanging or mounting the safety sleeve from a suitable rig structure. The rim may have a plurality of perforations allowing fasteners to secure the safety sleeve on the rig structure.

According to an embodiment of the present invention, the safety sleeve may comprise a cylindrical tubular body with a rim at one end thereof, for example an upper end for having the safety sleeve securely fastened to a corresponding component or feature of a rotary table. The rim and the corresponding component of the rotary table may comprise a plurality of perforations for securing the safety sleeve via a plurality of fasteners, such as threaded lugs and nuts.

According to another embodiment of the present invention, the safety sleeve may be secured within the housing by an annular packer urged against the safety sleeve by a piston or ram element, for example.

The safety sleeve may define the shape of an annular ring positioned within a housing in close proximity with the pipe string so that it may engage the stop arrangement of the pipe string. As it will be appreciated by those skilled in this art, after having read the disclosure of the present invention, the safety sleeve may also have any other suitable shape and size provided the safety sleeve does not interfere with the free movement of the pipe string relative to the housing through bore under normal operating conditions, but may also cooperate with the stop arrangement of the pipe string to limit the relative movement between the pipe string and the housing as may be needed.

The safety sleeve may be made of any suitable material capable to withstand the impact from the pipe string.

The safety sleeve may be made of any suitable metal such as for example steel, stainless steel or any other steel alloys. Other metals and metal alloys may also be used. High impact synthetic plastic materials may also be used.

The safety sleeve may comprise an impact absorption section, also referred hereinafter as a dampening section which may be aligned to engage the stop arrangement of the severed pipe string.

The safety sleeve may comprise a dampening section designed to absorb at least partially the energy of the impact from the pipe string, especially a severed pipe string.

The dampening section may be made of the same material as or a different material than the remainder of the safety sleeve.

The dampening section may comprise a softer material such as a softer metal that deforms upon impact to absorb at least partially the energy of the impact.

The dampening section may comprise a dampening mechanism.

The dampening mechanism may comprise, for example, an impact plate connected to the safety sleeve via one or more springs or coils that are adapted to absorb via compression at least a portion of the energy of the severed pipe string upon impact.

The safety sleeve may slidably fit around the pipe string. The clearance between the pipe string and the sleeve may be adjusted as may be needed depending on the particular seal design employed. For instance, for metal to metal seals, a smaller clearance may be employed than a clearance employed for O-ring type seals.

The safety sleeve may comprise a smooth, low friction side adjacent to the pipe string to facilitate the sliding movement of the pipe string while avoiding or minimising friction with the pipe string.

A dynamic seal may be positioned between the safety sleeve and the pipe string to seal off the clearance between the two. The dynamic seal may allow the pipe string to slidably move relative to the safety sleeve while minimising or completely preventing any fluid from escaping through the housing to the rig floor.

Different types of dynamic seals may be used. One example of a suitable dynamic seal may include a reciprocating seal having one or more O-rings. The O-ring may be positioned within grooves formed on the surface of the safety sleeve. The O-ring may be made of any suitable material. Mechanical metal to metal seals may also be used. To avoid damage to the pipe string because of friction between the pipe string and the sleeve, the sleeve may be made of a softer material than the pipe string.

The housing may comprise a seal for sealing around the safety sleeve. The seal around the safety sleeve may be a static seal. According to one embodiment, the housing may comprise an annular packer urged against the safety sleeve via a piston or ram element for sealing around the safety sleeve. The housing may comprise an inflatable bladder that upon activation inflates to form a seal around the safety sleeve. Other static seals may also be employed to seal off the area around the safety sleeve as may be needed.

The retainer device may be a new device that is installed in the rig solely for the purpose of retaining a pipe string or it may be a part of a larger structure performing other needed functions in pipe string operations.

The retainer device may be an existing structure that is retrofitted. For example, the retainer device may be a retrofitted diverter often found in existing pipe string systems deployed form a rig. The diverter may by retrofitted by mounting a safety sleeve within the diverter housing so that the safety sleeve may engage the stop arrangement of the pipe string. The safety sleeve may be secured to the housing using one of many well-known techniques. For instance the safety sleeve may include a rim end that can be suspended from a rotary table that is typically found in a rig adjacent a diverter through bore. The rim end of the safety sleeve may contain a plurality of perforations to allow securing it to the rotary table via a plurality of fasteners such as threaded lugs and nuts. The safety sleeve may be mounted at least partially to the diverter housing via a plurality of methods such as fasteners or welding. Other methods, well known in the art, may be employed for securely mounting the safety sleeve to the housing as it would be appreciated by a person skilled in this art.

The pipe string assembly comprises at least one stop arrangement.

The stop arrangement may be an integral part of a tubing that can be connected to the pipe string.

The stop arrangement may be a clamp-on structure that can be mounted to the pipe string via one or more fasteners.

The stop arrangement may be of any suitable shape and size and may be made of any suitable material. The stop arrangement may be adapted to engage sufficiently with the safety sleeve and withstand impact with the safety sleeve in order to limit the relative movement between the housing of the retainer device and the pipe string.

The stop arrangement may be made of any suitable metal such as for example steel, stainless, or any other steel alloys. Other metals and metal alloys may also be used. High impact synthetic plastic materials may also be used.

The stop arrangement may comprise a continuous annular structure such as a ring.

The stop member may comprise a discontinuous annular structure such as a fluted ring comprising a plurality of cut-outs to allow free fluid movement past the stop ring through an annulus formed between the string and a larger diameter pipe within which the pipe string is deployed.

One or more stop arrangements may be used. According to one embodiment a plurality of stop arrangements may be positioned in series along the pipe string. According to such configuration, each stop arrangement may be designed to withstand a lower impact force than the embodiment where a single stop arrangement is used. Upon the failure of the first stop arrangement the severed pipe may continue moving upwards at a reduced speed until a second stop arrangement may engage the safety sleeve of the retainer device. Thus, the total energy of a severed pipe sting string may be dissipated through a series of smaller impacts with the safety sleeve.

The stop arrangement may also comprise a dampening portion and/or a dampening mechanism to reduce the initial impact of the stop arrangement against the safety sleeve.

The dampening portion of the stop arrangement may be made of the same or different material than the rest of the stop arrangement. The dampening portion of the stop arrangement may be made of a softer material in order to soften the initial impact.

The dampening portion may comprise a dampening mechanism comprising one or more concentric stop arrangements connected via a plurality of high tension springs or coils. Such an arrangement may lessen the impact energy that may need to be absorbed by the safety sleeve.

As it will be appreciated with a skilled person in this art, the pipe string may be any pipe string such as a drill string, or a landing string used in oil and gas operations such as subsea drilling, workover or production operations. The pipe string may be deployed within a larger pipe string, such as a marine riser, as is common, for instance to deploy landing strings used for subsea workover operations within a larger marine riser.

Another aspect of the present invention relates to an emergency string tensioning system for providing a connection between an object and a structure, the emergency string tensioning system comprising one or more tensioning modules each tensioning module comprising: a housing; a telescopic member extending from the housing; a telescopic arrangement mounted relative to the housing and operatively connected to the telescopic member, the telescopic arrangement comprising a first piston and first and second resistance arrangements; wherein upon relative movement between the telescopic member and the housing in a first direction the first piston is caused to move sequentially against the first and second resistance arrangements.

The emergency string tensioning system may be used with a floating, jack-up or stationery rig. The compensation system may be used, for example, with a mobile offshore drilling unit in conjunction with a subsea well, such as a semi-submersible drilling unit, a drill vessel, or a jack-up rig.

The emergency string tensioning system may be used with a jack-up drilling rig used in conjunction with a surface well on a steel jacket. The emergency string tensioning system may also be used with a stationery drilling unit on a development field, for example.

The emergency string tensioning system may be particularly advantageous with a floating platform or vessel. The emergency string tensioning system may be used in conjunction with a primary or a secondary heave compensation system.

The structure may be any rig structure including but not limited a heave compensation system mounted to a rig structure.

The structure may be connected to the telescopic member or to the housing of the emergency string tensioning system.

The object may be a pipe string.

The object may be connected to the telescopic member or to the housing of the emergency string tensioning system.

According to one embodiment, the object may comprise a pipe string such as a landing string or drill pipe string suspended from an oil and gas floating vessel.

The emergency string tensioning system may be connected to the structure at a first end and to the object at a second end via any suitable connectors. For example, an object such as a pipe string may be connected to the telescopic member of the tensioning module via a pipe connector whereas the housing of the tensioning module may be connected to a structure such as an oil and gas vessel with another connector.

In operation, the emergency string tensioning system may assist to regulate the tension exerted on the object during relative movement of the object to the structure. For example, the emergency string tensioning system may act as a temporary heave compensation system to compensate for the relative movement between a pipe string and an offshore rig or vessel caused by the influence of waves.

In operation, as the telescopic member pulls the first piston in one direction, the first piston may move against the first resistance arrangement. Continuous movement of the telescopic member in the same direction may result in the first piston overcoming the resistance of the first resistance arrangement and thereby engaging the second resistance arrangement. Upon engagement of the second resistance arrangement, further movement of the telescopic member in the same direction may be accomplished by urging the first piston against the second resistance arrangement.

The emergency string tensioning system may act as a temporary primary heave compensation system, in the absence of any other functional heave compensation system, until such time as the pipe string can be safely disconnected from the well.

The emergency string tensioning system may act as a temporary secondary heave compensation system providing finer and or additional compensation to the one provided by a primary or another secondary heave compensation system.

The emergency string tensioning system may be used in conjunction with a retainer system such as a retainer system as defined in any other aspect of the present invention.

The emergency string tensioning system may further comprise a lock and release module or mechanism which in a locked configuration may secure the telescopic member to the housing to prevent relative movement therebetween and in a released configuration may release the telescopic member to permit relative movement therebetween.

The emergency string tensioning system may further comprise a lock and release module or mechanism that locks the telescopic member to the housing so long as the tensile force exerted on the telescopic member is below a predetermined level. When the tensile force exerted on the telescopic member reaches or exceeds the predetermined level then the lock and release mechanism may be unlocked to release the telescopic member to allow it to extend under the pull of the object acting initially against the first resistance arrangement, and upon continuous, increasing pull in the same direction, against the second resistance arrangement. In this manner, the tensile force exerted on the pipe string may be maintained below a certain desired level to reduce the risk of damage and/or mechanical failure of the object, such as severing of a pipe string that may occur for pipe strings deployed from a floating rig.

The lock and release mechanism may be a manual lock and release mechanism, a remotely actuated lock and release mechanism, or a combination thereof.

The lock and release mechanism may, according to one embodiment, comprise one or more shear pins or retractable pins. Under normal operating conditions, the one or more shear pins, may be designed to break or retract under a mechanical overload that reaches or exceeds a certain predetermined level. For example, each shear pin may be designed to shear once the mechanical overload reaches or exceeds a safe tensile failure limit for the object.

The housing of the compensation module may be made of or comprise any suitable material such as steel, stainless steel, or any other steel alloys. Other metals or metal alloys may be used.

The housing may comprise a single outer cylinder defining a cavity therein within which the telescopic arrangement may be disposed either wholly or partially.

The housing may comprise an inner cylinder mounted within the housing and extending along a partial length of the housing. The inner cylinder may comprise the first resistance arrangement. The inner cylinder may further comprise the first piston of the telescopic arrangement. The inner cylinder may be slidably movable within the inner cylinder against the first resistance arrangement.

The housing may comprise first and second ports in pressure and/or fluid communication with external pressure and/or fluid accumulators. The first port may generally be disposed at a median position along a longitudinal axis of the housing whereas the second port may generally be positioned at a position proximate one end of the cavity of the housing, for example proximate to the telescopic member.

The telescopic member may be disposed wholly or partially within the housing. The telescopic member may comprise an end connector for connecting the telescopic member to the object. The telescopic member may further comprise a piston rod for connecting the end connector to the first piston of the telescopic arrangement.

The telescopic arrangement may comprise a second piston that is slidably movable within a cavity of the housing. The second piston may be movable within the housing cavity against the second resistance arrangement.

The first piston of the telescopic arrangement may be disposed within the housing inside a cavity defined by the housing. The first piston may be adapted to slidably move within the cavity of the housing from a first position proximate one end of the housing that it is distal from the telescopic member, to a second position generally median along the longitudinal axis of the housing. Alternatively, the cavity within which the first piston may travel may be defined by an inner cylinder mounted within the housing.

The telescopic arrangement may comprise a second piston which is disposed within the cavity of the housing and may slidably move within the cavity against the second resistance arrangement. The second piston may be movable upon engagement by the first piston from a first position that may coincide with the second position of the first piston, to a second position defined by the end of the cavity of the housing and which is proximate to the end connector of the telescopic member. The second piston may comprise a central, through bore through which the piston rod of the telescopic member may freely move relative to the second piston.

The telescopic arrangement may comprise a cylinder that is an integral part of the second piston. The cylinder of the telescopic arrangement may together with the first and second pistons define a first chamber within which the first piston may slidably move under the pull of the telescopic member against the first resistance arrangement.

The telescopic arrangement may comprise a first and a second chamber. The first chamber may be defined between the first and second pistons. The second chamber may be defined between the second piston and the end of the cavity that it is proximate to the telescopic member.

The telescopic arrangement may further comprise seals to provide fluid and/or pressure isolation between the first and second chambers.

The first and second resistance arrangements may provide the same or different resistance against the relative movement between the telescopic member and the housing.

The second resistance arrangement may provide greater resistance than the first resistance arrangement.

The first and second resistance arrangements may comprise first and second chambers containing first and second fluids maintained at the same or different pressures.

The first chamber may be defined within a cavity of the housing between the first and second pistons. The first chamber may be defined between an inner cylinder and the first and second pistons. The inner cylinder may be an integral part of the second piston.

The second chamber may be defined within the cavity of the housing between the second position and an end of the cavity of the housing.

The telescopic arrangement may comprise first and second fluid accumulators. The first and second fluids in the first and second fluid chambers may be maintained at first and second pressures via fluid connection with the first and second fluid accumulators.

The fluid accumulators may be disposed within or outside the housing.

The fluid accumulators may be in fluid communication with respective first and second chambers via first and second ports and related conduits.

The fluid accumulators may be kept at desired pressures via any well-known technical means such as for example employing one or more pressurized gas cylinders operatively connected to the fluid accumulators.

During operations, the first resistance arrangement may provide a first constant tension to the object, controlled by a set point mechanism, acting in support of another compensation system such as a primary heave compensation system for a floating rig. The first resistance arrangement may provide finer regulation of the tension exerted on the object such as pipe string than the one provided compensation system can provide. The first resistance arrangement may act as a pure back-up for constant object tension, in case for instance the primary rig heave compensation system may not be functioning as intended. It should be understood that the regulation mechanism may comprise the supply of hydraulic pressure, or any other suitable technical device If a serious malfunction occurs with the primary rig heave compensation system, the first piston may bottom out on top of the second piston. In that event, if the compensation system is forced to extend further, as it may occur in the event of a rig heave compensator lock-up, the second resistance arrangement may act as an emergency break.

As a result, the tension force that the emergency string tensioning system provides may increase, but preferably not to a point where the object may be severed. This is achieved by pre-setting second resistance arrangement to provide a higher resistance than the resistance provided by the first resistance arrangement.

In the embodiment employing fluids within the first and second chambers, the second chamber fluid may be maintained at a higher pressure than the first fluid chamber. Employing pressurized fluids to provide the required resistance to the movement of the pistons allows easy control of the desired pressures either manually or remotely.

However, other resistance arrangements may be employed. For example, instead of, or in addition to a pressurized fluid disposed within the first and/or second chambers, a resistance arrangement may comprise one or more compression springs or coils. The compression springs or coils may be anchored within circular plates that slidably fit within the respective chambers. The circular plates may comprise a central bore to allow a piston rod that may connect the telescopic member to the first piston to pass through the circular plates. Alternatively, one or more compression springs or coils may be anchored directly to the first and second pistons inside the first chamber and between the second piston and the end of the cavity that is proximate the telescopic member.

According to one embodiment of the present invention a tensioning module comprises: a housing defining a cylindrical cavity; a telescopic member extending from the housing; a first and a second piston disposed within the cylindrical housing both pistons being slidably movable within the cylindrical cavity; a piston rod operatively connecting the telescopic member to the first piston; a first chamber defined between the first and second pistons the first chamber containing a first fluid at a first pressure; a second chamber defined between the second piston and an end of the cylindrical cavity the second chamber containing a second fluid at a second pressure, wherein the second pressure is higher than the first pressure.

In use, the telescopic member may be connected to a pipe string, and movement of the pipe string causes the telescopic member to pull the first piston against the first fluid in the first chamber. The housing may further contain a first port positioned generally near a median position within along the longitudinal axis of the housing. The first fluid may thus be displaced through the first port to a first fluid accumulator. The fluid pressure may be maintained by any many well-known methods such as for example the use of a pressurized gas cylinder providing the required pressure to the first fluid accumulator.

Upon displacement of the first fluid from the first chamber the floating piston may then engage the second piston and under the pulling from the telescopic member urges the second piston against the second fluid that is disposed within the second chamber. The housing may further contain a second port positioned generally near a position proximate to the end of the cylindrical cavity that is proximate to the telescopic member. The second fluid may thus be displaced through the second port to a second fluid accumulator.

Yet another aspect of the present invention relates to a method for arresting pipe string from being ejected over a rig floor during a severed pipe string incident using a retainer system or a retainer device in conjunction with a stop arrangement installed on a pipe string.

It should be understood that the features defined in relation to one aspect may be applied or provided in combination with any other aspect of the present invention. For example, any defined methods of operation, apparatus or system disclosed herein may relate to operational steps with a method or process.

BRIEF DESCRIPTION OF THE DRAWINGS

These and other aspects of the present invention will now be described, by way of example only, with reference to the accompanying drawings, in which.

DETAILED DESCRIPTION OF THE INVENTION

During subsea drilling, workover or production operations, a pipe string such as a drill string, or a landing string may connect a subsea well to a rig or platform such as a floating platform or vessel. The pipe string may be deployed within a larger pipe string, as is common, for instance, to deploy landing strings used in workover operations within a larger marine riser. The marine riser may also connect the subsea well to the rig. Typically, a first end of the pipe string may be suspended from a derrick positioned on the rig floor while a second end may be connected to the subsea wellhead. Although the invention will now be described in reference to a landing string system and a floating platform, it should be understood that the present invention retainer system may be employed equally with any other pipe string or rig.

Figure 1:
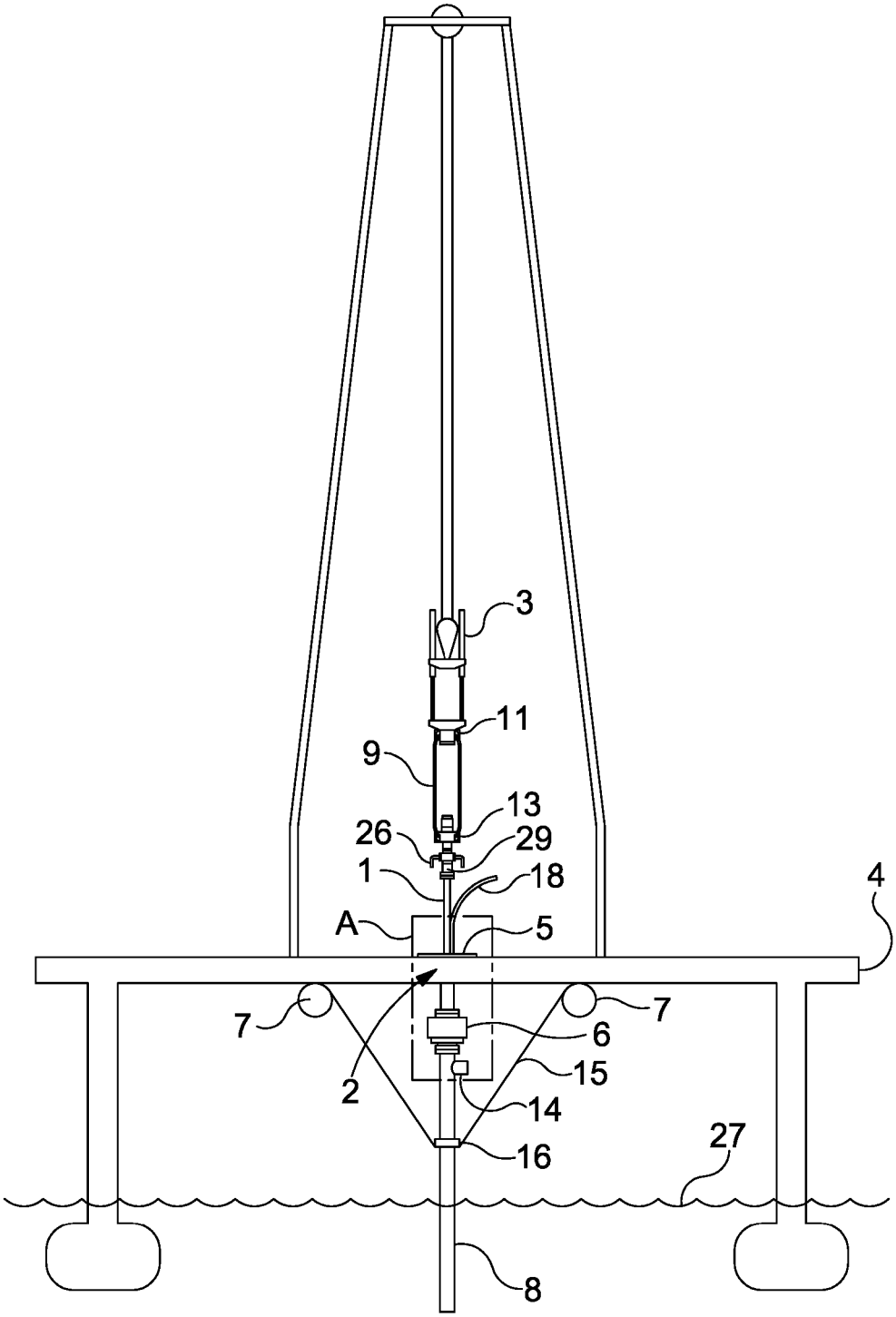
FIG. 1 is a simplified diagrammatic illustration of an upper region of a retainer system according to an embodiment of the present invention, wherein a pipe string is shown suspended from a floating platform.

Referring now to FIG. 1, an upper region of a retainer system, generally identified by numeral 2 according to an embodiment of the present invention is provided, wherein a pipe string 1 is shown suspended from a platform or rig 4 floating on a body of water 27. The pipe string 1 is a landing string suspended from a heave compensated top drive 3 mounted on a rig. It should be understood that the invention works equally well for pipe string systems deployed from any type of platforms or vessels including but not limited to mobile offshore drilling units employed in conjunction with subsea wells, or Jack-up drilling rigs employed in conjunction with surface wells on a steel jacket, or stationary drilling units employed in development fields.

The landing string 1 is suspended from the top drive 3 via cables or rigid rods 9, clamps 13, 11 and pipe connector 29. Pipe connector 29 may have fluid connections 26 for supplying fluids to the landing string and/or bleeding down any fluids trapped in the landing string during decommissioning.

The landing string 1 is deployed through a rotary table 5, a retainer device 6 and a workover riser 8. The landing string 1 is connected at its lower end to a wellhead of a subsea well (not shown). Tensioned cables 15 suspend the riser 8 from a riser connector 16 to a riser heave compensator arrangement 7.

A umbilical 18 is shown placed next to the landing string 1 for providing fluid, power, data communication, control communication or a combination thereof to the landing string 1 and or operations in an associated well or well equipment.

The retainer device 6 as shown in FIG. 1 comprises a retrofitted flow diverter housing. An outlet 14 is mounted to the housing 6, however, it should be understood that the outlet may form an integral part of the housing 6, however, it should be understood that the retainer device may comprise a specifically made housing.

A flow diverter is typically positioned below a rig floor, between riser and the rotary. The flow diverter may be used to safely vent unbalanced wellbore pressure which may otherwise escape from the top of the riser, thereby posing a hazard to personnel and equipment.

Figure 2:
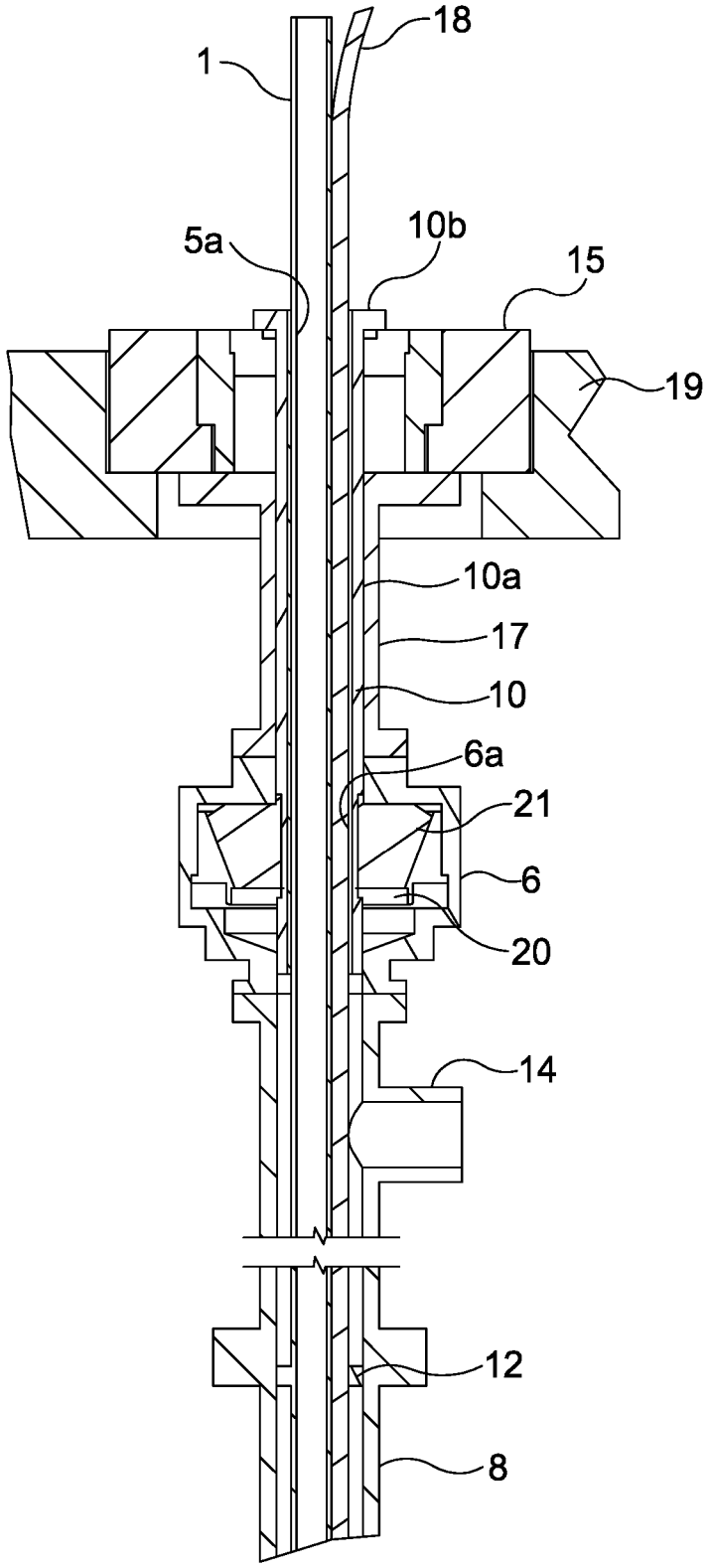
FIG. 2 is an enlarged, longitudinal cross-sectional view of region A of the retainer system of FIG. 1 showing a pipe string extending through a rotary table, and a retainer device in a normal operating condition.

Referring now to FIG. 2, an enlarged, longitudinal cross-sectional view of region A of FIG. 1 is provided, showing the flow diverter housing 6 mounted via a cylindrical connector member 17 to a rig structure 19 below the rotary table 5. The flow diverter housing 6 defines a through bore 6*a* along a central longitudinal axis. The flow diverter housing is positioned immediately below the rotary table so that the through bore 5*a* of the rotary table 5 may be aligned with the through bore 6*a* of the flow diverter housing 6.

A safety sleeve 10 having a cylindrical tubular body 10*a* and a rim at an upper end 10*b* is suspended, via the rim end 10*b*, from the rotary table 5. The safety sleeve 10 extends through the through bore 5*a* of the rotary table 5, through the cylindrical connector member 17 and into the through bore 6*a* of the flow diverter housing 6. The flow diverter housing 6 comprises a piston or ram element 20 which may be activated to urge an annular packer element 21 against the safety sleeve 10 to seal off the area around the safety sleeve 10.

The annular packer element 21 may be made of any suitable packer material for obtaining effective sealing around the landing string 10. A dynamic seal (not shown) may be employed between the safety sleeve 10 and the landing string 1 to seal off the clearance between the safety sleeve 10 and the landing string 1 as the landing string 1 moves relatively to the housing during operations.

The safety sleeve 10 may be secured to the rotary table 5 by connectors (not shown) such as threaded lugs and nuts. Other connectors may be used to connect the safety sleeve to the diverter housing 6. However, it should be understood that the safety sleeve 10 may alternatively be securely positioned within the flow diverter housing 6 simply by the action of the piston 20 urging the annular packer element 21 against the safety sleeve 10. Stated otherwise, the safety sleeve 10 may be sufficiently secured within the housing simply by the action of the piston 20 urging the packer element 21 against the safety sleeve 10 rendering the need to secure the safety sleeve 10 via connectors redundant.

The landing string 1 comprises a stop arrangement 12. The stop arrangement 12 may be securely mounted at the external surface of the landing string 1. During normal operations, neither the safety sleeve 10 nor the stop arrangement 12 may interfere with the free movement of the landing string 1.

Figure 3:
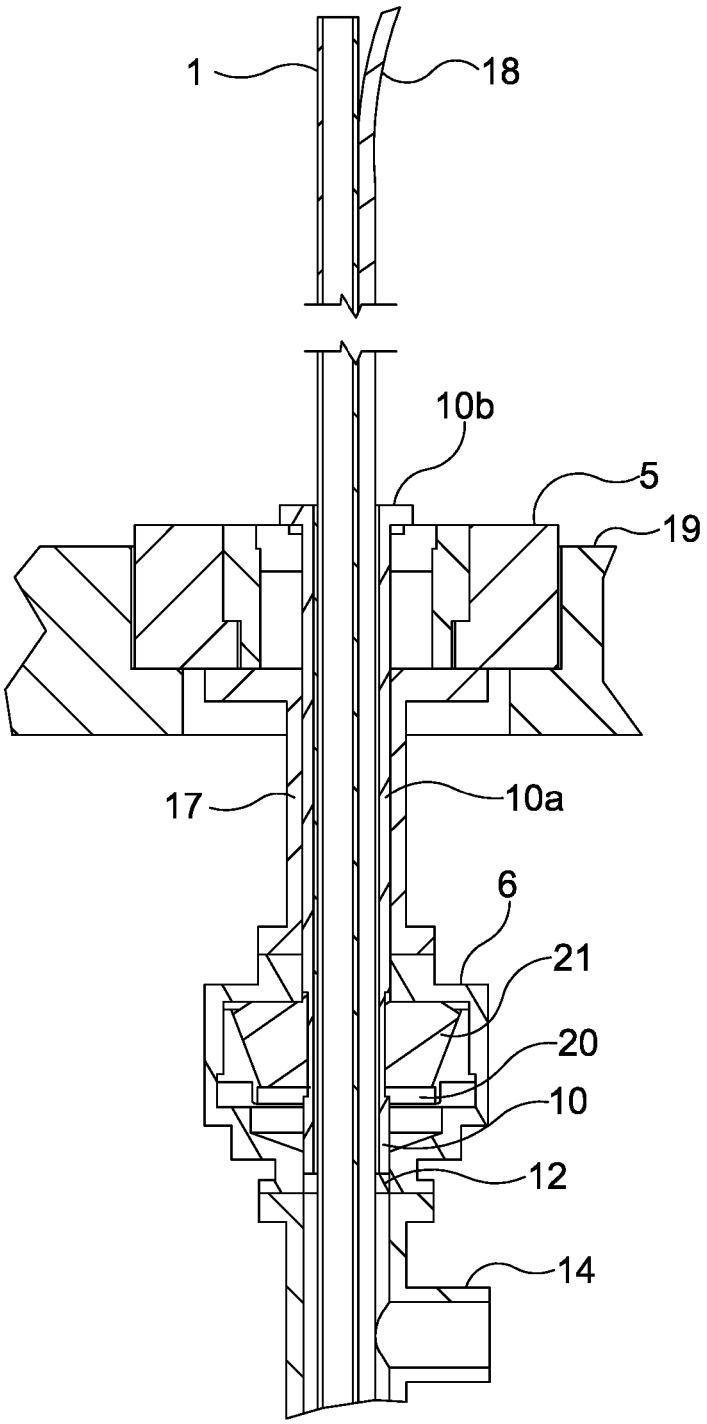
FIG. 3 is an enlarged, longitudinal cross-sectional view of region A of FIG. 1, in an emergency condition, wherein a severed pipe string is stopped by the engagement of a stop arrangement associated with the pipe string with a safety sleeve of the retainer device, according to an embodiment of the present invention.

However, in the event of an emergency situation, the safety sleeve 10 may engage the stop arrangement 12 of the landing string 1 to stop the upward movement of the landing string 1 as it is shown in FIG. 3. Thus, the retainer system may limit the relative movement between the landing string 1 and the housing 6 to prevent the severed landing string 1 from ejecting out of the housing.

Figure 4:
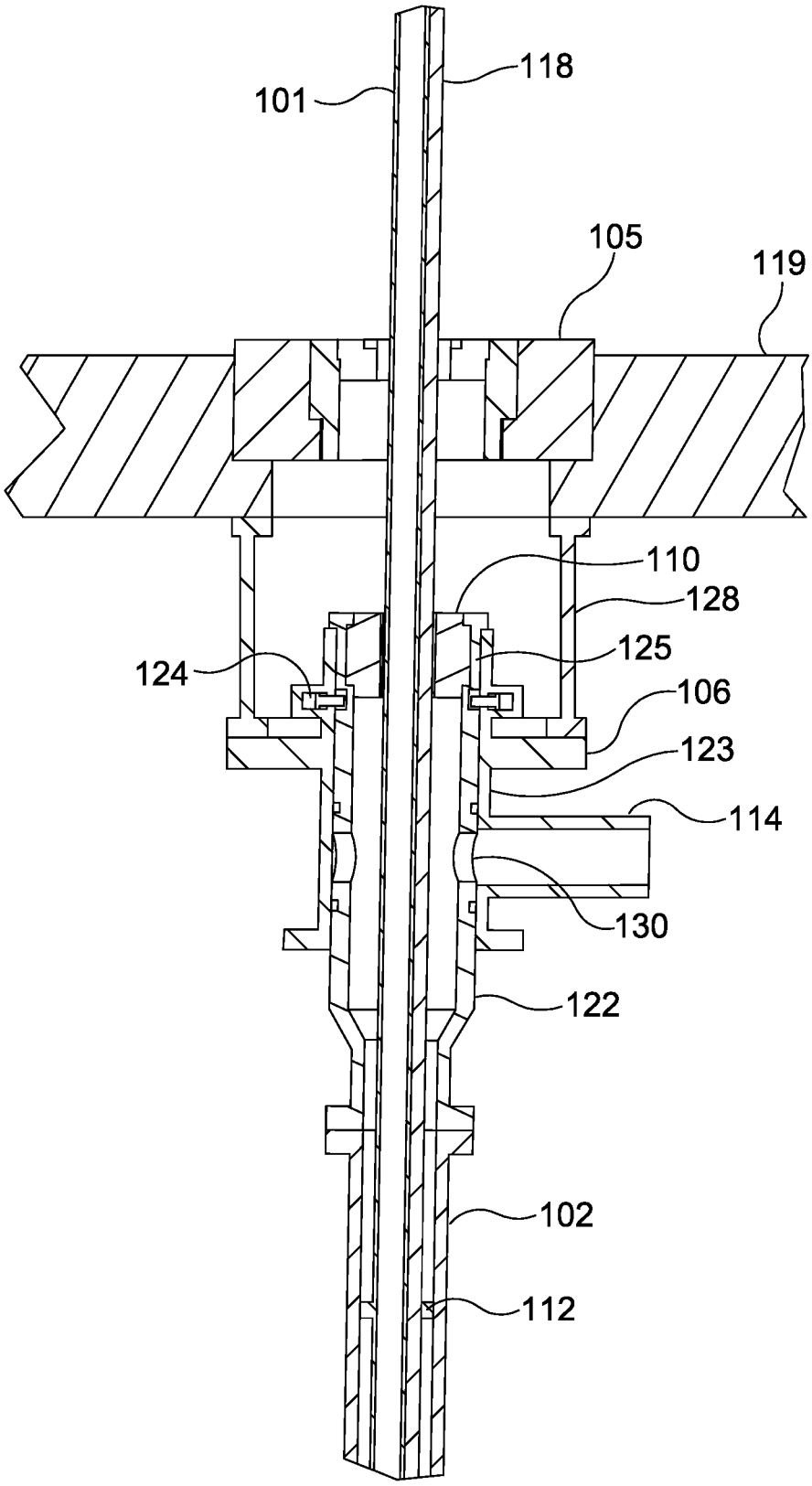
FIG. 4 is an enlarged, longitudinal, cross-sectional view of region A of FIG. 1 showing a different embodiment of the present invention retainer system in a normal operating condition.
Figure 5:
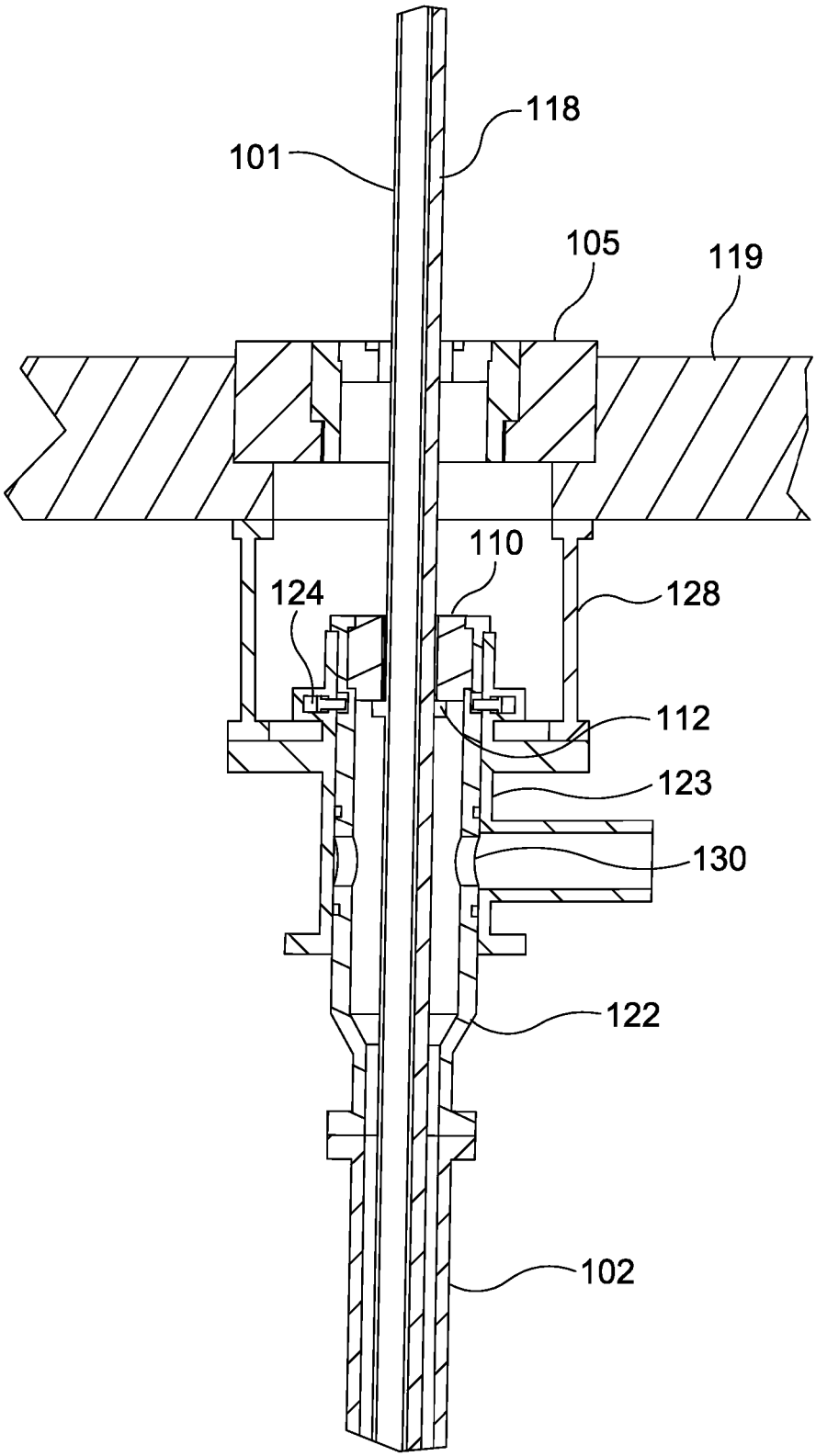
FIG. 5 is an enlarged, longitudinal cross-sectional view of region A of FIG. 1 of the same embodiment as the one shown in FIG. 4 but in an emergency situation.

Referring now to FIGS. 4 and 5, another embodiment of the retainer system is provided that employs a diverter housing 106 similar to those used in connection with insert packer diverters. Features of the embodiment of FIGS. 4 and 5 which are similar to features shown in the embodiment of FIGS. 2 and 3 employ like numerals, incremented by 100. The embodiment of FIG. 4 may be implemented by retrofitting existing insert packer diverters, however it may also be implemented by constructing a custom made housing 106.

The housing 106 comprises a first outer member 122 and a second inner member 123 assembled together via a plurality of fasteners 124. First outer member 123 is mounted to a rig structure 119 via a connector member 128. First outer member 123 defines an outlet 114 which is in fluid communication with a corresponding port 130 of the second inner member 122. A marine riser 108 is mounted to a lower end 122*a* of the second inner member 122.

A safety sleeve 110 comprises an insert placed inside a corresponding pocket 125 of the first inner member 122 of the housing 106. The insert and pocket as shown in this embodiment may be of a bayonet design allowing the insert to be readily dropped or inserted inside the pocket 125 at a first time and locked in place by turning it at a second time. Such a design is advantageous as it may facilitate installation and maintenance both for retrofit as well as custom made systems. However, other means of securing the insert may be employed such as for example using a threaded insert fitting within a corresponding female threaded pocket. Other means of securely mounting the safety sleeve 110 may be used.

Further, it should be appreciated by the skilled person that the shape, size and material of construction of the safety sleeve 110 may vary, provided that the safety sleeve 110 is designed to not interfere with the relative movement or proper functioning of the landing string 1 during normal operations. At the same time, the safety sleeve 110 should provide adequate resistance to the impact upon engagement of the stop arrangement 112 of the landing string 1, in an emergency condition.

A dynamic seal (not shown) may be employed to seal off the clearance between the safety sleeve 110 and the landing string 101. Also, a static seal (not shown) may be employed to seal off the area between the safety sleeve 110 and the first inner member 22 of the housing 106. Conventional well-known dynamic or static seals may be employed.

The landing string 101 has a stop arrangement 112. The stop arrangement may be mounted at the external surface of the landing string 101 using one or more well-known fasteners or may form an integral part of a landing string section. The safety sleeve 110 may be positioned within the pocket 125 allowing sufficient clearance between the safety sleeve 110 and the landing string 101 to permit free vertical movement of the landing string 1, in normal operating conditions as shown in FIG. 4.

In an emergency situation, if the landing string 101 is severed because of excessive tension overcoming the tensile failure limit of the landing string 101, the upper part of the landing string 101 may be prevented to eject out of the housing 106 by virtue of the safety sleeve 110 engaging the stop arrangement 112 of the landing string 1 as shown in FIG. 5.

Figure 6:
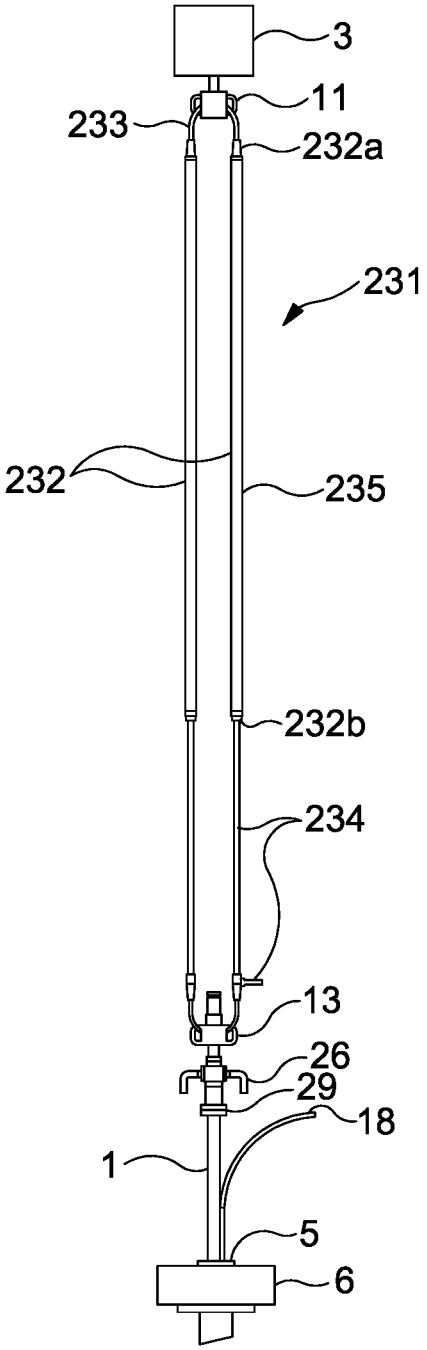
FIG. 6 is a diagrammatic illustration of a retainer system comprising a constant tension bail system, according to an embodiment of the present invention.

Referring now to FIG. 6, another embodiment of the present invention retainer system is provided, comprising an emergency string tensioning system 231 also referred to herein as a constant tension bail system 231. However, it should be understood that the retainer system may be used in combination with any other heave compensation system and may not be limited to the constant tension bail system 231 as shown in FIG. 6. It should be noted that the embodiment of the retainer system of FIG. 6 shares many features in common with the embodiment of FIG. 1, and for easy reference any common features are denoted using the same numerals as in the FIG. 1. As shown in FIG. 6, the emergency string tension system 231 comprises two identical tension modules 232 employed to suspend a landing string 1 from a top drive 3. Each tension module is referred to hereinafter also as a constant tension bail or bail. It should be understood that the emergency string tensioning system may comprise one or more constant tension bails 232 without departing from the scope of the present invention. Each bail 232 comprises an outer cylindrical housing 235 and end connectors 232*a* and 232*b* attached at each end of the housing 235. End connectors 232*a* are connected via cables 233 to a clamp 11 which is, in turn, mounted to the top drive 3. End connectors 232*b* are connected via cables 234 to a pipe clamp 13 which is, in turn, attached to the landing string 1.

Under normal operating conditions, the constant tension bail system 231, as shown in FIG. 6, operates like ordinary bails, i.e. without extension. However, when the tension exerted on the system exceeds a predetermined level then the constant tension bail system 231 may extend in order to provide supplementary tension regulation and prevent the severing or breaking of the landing string 1.

Figure 7A:
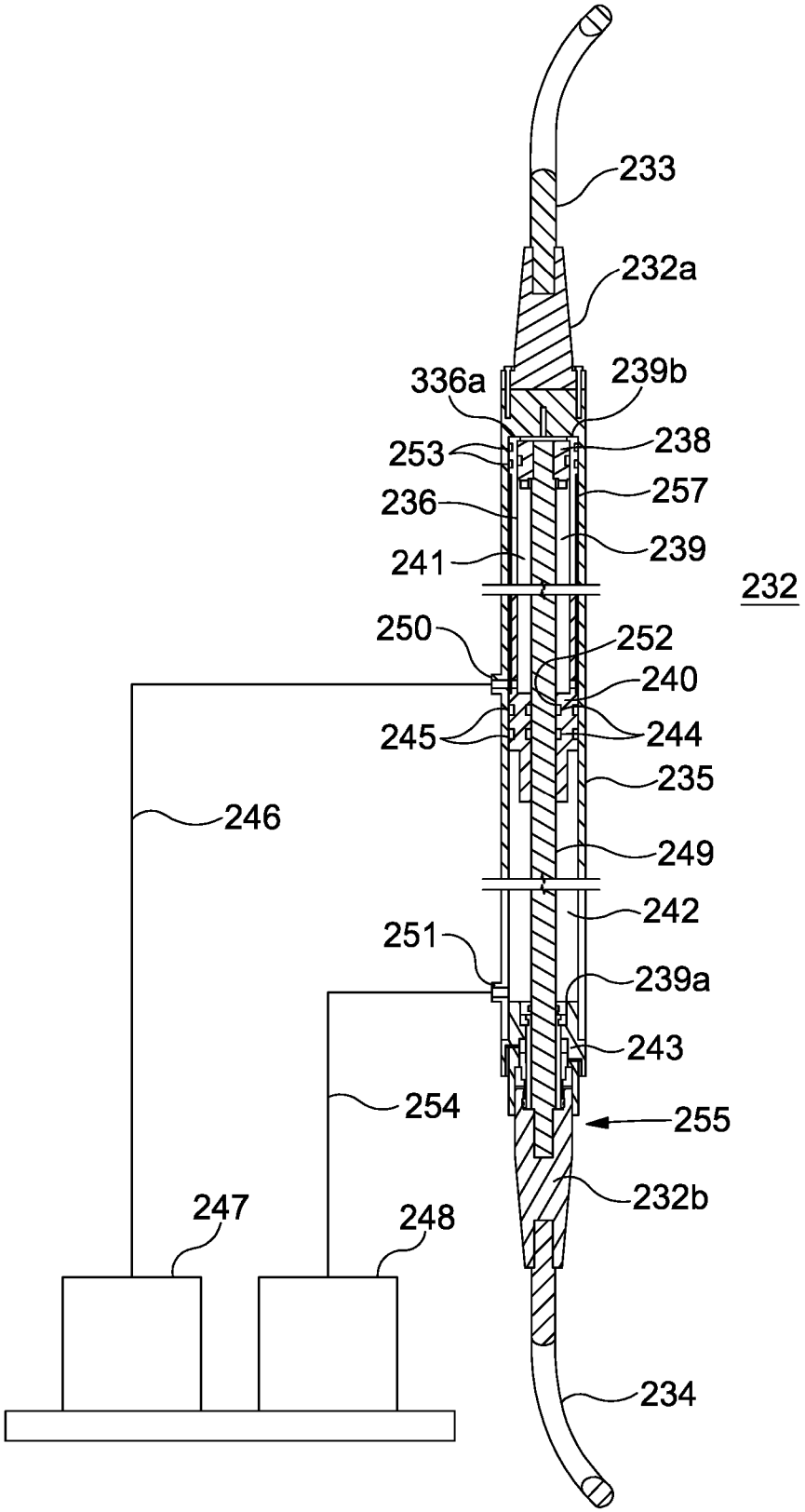
FIG. 7A is an enlarged, longitudinal cross-sectional view of a constant tension bail shown connected to low and high fluid accumulators in a locked position, according to an embodiment of the present invention.

Referring now to FIG. 7A the structure of an embodiment of the constant tension bails 232 will be described in more detail. The constant tension bail comprises a cylindrical housing 235 which defines a cylindrical cavity 239 therein. The bail 232 further comprises a telescopic member generally designated with numeral 255 which in a normal operating condition as shown in FIG. 7A is locked to the outer cylindrical housing 235 using a lock and release module or mechanism generally designated with numeral 243. The telescopic member 255 comprises an end connector 232*b* having a cable 234 connected thereto at one end for connecting the bail 232 to a pipe string. The telescopic member 255 further comprises a piston rod 249 which connects the telescopic member to a first piston 238.

The cylindrical housing 235 further defines two ports, a first port 250 also referred to hereinafter as a low pressure port, and a second port 251 also referred to hereinafter as a high pressure port. The second port 251 is disposed generally proximate a lower end 239*a* of the cylindrical cavity 239. The first port 250 is disposed proximate a median position between lower and upper ends 239*a* and 239*b* of the cylindrical cavity 239.

Alternatively, if in the event that tension from for example a primary or secondary heave compensator reaches below a predetermined level due to malfunction or failure, the constant tension bail system will retract in order to maintain a predetermined level of tension on the landing string.

A second piston 240 having an inner cylinder 236 integrally mounted thereon is disposed within the cavity 239 of the cylindrical housing 235. Inner cylinder 236 extends from the second piston 240 to the upper end 239*b* of the cylindrical cavity 239. A first chamber 241 is defined within cylinder 236 between first and second pistons 238 and 240. Seals 253 provide sealing between the inner cylinder 236 and the cylindrical housing 235.

Inner cylinder has a port 257 so that the first port 250 may be in fluid communication with first chamber 241 via an annulus 260 defined between the inner cylinder 236 and the cylindrical housing 235. First piston 238, also referred to as a floating piston, is slidably movable within the inner cylinder 236 between a first upper position proximate to the end 239*b* of the cylindrical cavity 239 to a second position defined by the end 236*a* of inner cylinder 236.

The floating piston 238 is connected to the telescopic member 255 via the piston rod 249. The piston rod 249 extends from the floating piston 238, through a through bore 252 defined centrally within second piston 240, to the telescopic member 255.

The second piston 240 is also referred to herein as a slow moving piston. The second piston 240 may slidably move within the cavity 239 defined within the outer cylindrical housing 235 from a first position starting at the end of the inner cylinder 236*a* to a second position defined by the end 239*a* of the cylindrical cavity 239.

The second piston 240 comprises a central through bore 252 through which the piston rod 249 may freely move relative to the second piston 240. A second fluid chamber 242 is defined within the cavity 239 between the second piston 240 and the end 239*a* of the cylindrical cavity 239. Seals 244 are disposed on the internal surface of the through bore of piston 240 and seals 245 are disposed on the external surface of piston 240 to ensure pressure and fluid isolation between the first and second chambers 241 and 242.

Chamber 241 contains a first fluid maintained at a first pressure by fluid supplied via port 250 and a related conduit 246 from a first fluid accumulator 247. Chamber 242 contains a second fluid maintained at a second pressure by fluid supplied via port 251 and a related line 254 from a second high fluid accumulator 248.

Each constant tension bail 232 may further comprise a lock and release mechanism 243 that locks the telescopic member 255 to the outer cylindrical housing 235 so long as the force exerted on the telescopic member 255 is below a predetermined level.

When the force exerted on the telescopic member 255 reaches or exceeds the predetermined level, then the lock mechanism 243 is unlocked to release the telescopic member 255 to extend in order to reduce the tensile force exerted on the pipe string. Thus, so long as the lock mechanism 243 is engaged, each constant tension bail 232 may not extend. However, while the lock mechanism 243 is engaged, each constant tension bail 243 may retract when the force exerted on the telescopic member 255 reaches below a predetermined level.

The lock mechanism may be a manual lock and release mechanism, a remotely actuated lock and release mechanism, or a combination thereof.

If the lock mechanism 243 is manual, the bails 232 may be locked manually upon installation, and may be manually released by use of riding belt operations in the derrick or they may be manually accessed from a work platform to release them. For re-locking the bails 232, another manual rigging belt or work platform operation would have to be performed.

If a remotely actuated bail lock and release mechanism is used, a cable may be used to connect the bails to a control panel for the activation mechanism Release or re-engagement of the lock, as may be needed, may be performed remotely via the control panel. The lock mechanism may, according to one embodiment, comprise one or more shear pins (not shown) that hold the telescopic member securely attached to the housing 235.

Under normal operating conditions the shear pin may be designed to break under a mechanical overload that reaches or exceeds a certain predetermined level. The shear pin may be designed to shear once the mechanical overload reaches or exceeds a safe tensile failure limit for the landing string.

During use, the floating piston 238 may provide a first constant tension to the landing string 1, controlled by a set point mechanism, acting in support of the normal rig heave compensation system, by providing a finer regulation of the landing string tension than the rig heave compensation system can provide. The floating piston may also act as a pure back-up for constant string tension, in case the rig heave compensation system is not functioning as intended.

Figure 7B:
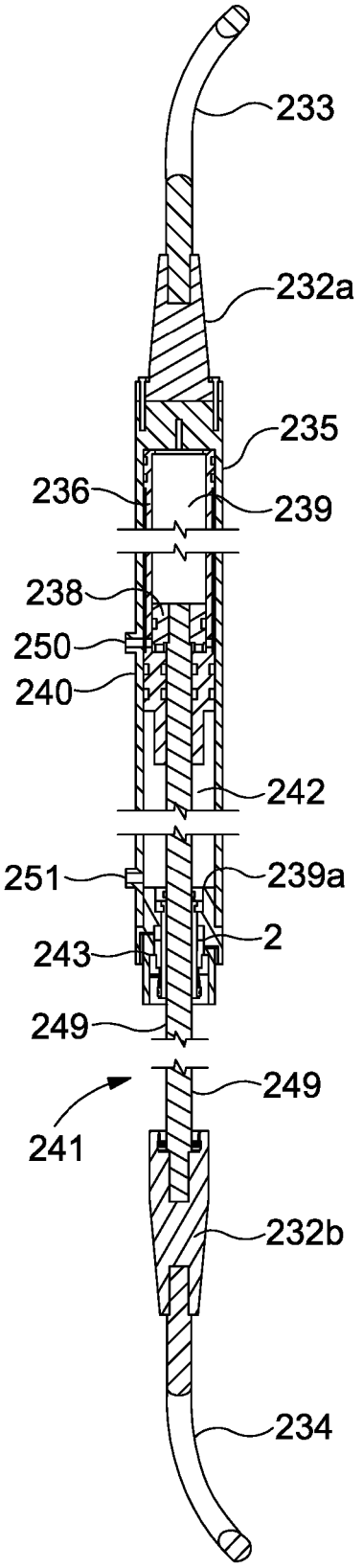
FIG. 7B is a longitudinal cross-sectional view of a constant tension bail shown in a mid-stroke position, according to an embodiment of the present invention.

If a serious malfunction occurs with the rig heave compensation system, the floating piston 238 will bottom out on top of the second piston 240 as shown in FIG. 7B. In that event, if the bail 232 is forced to extend further, as it may occur in the event of a rig heave-compensator lock-up, the second piston 240 would act as an emergency break.

As a result, the tension force that the bail 232 provides will increase, but preferably not to a point where the landing string 1 may be severed. This is achieved by the higher pressure hydraulic fluid of chamber 242, supplied by the external hydraulic accumulator 248 via port 251. The tension force level maintained may be pre-set via a regulation mechanism. The regulation mechanism may be hydraulic pressure supplied by accumulator 248, or any other suitable technical device.

Figure 7C:
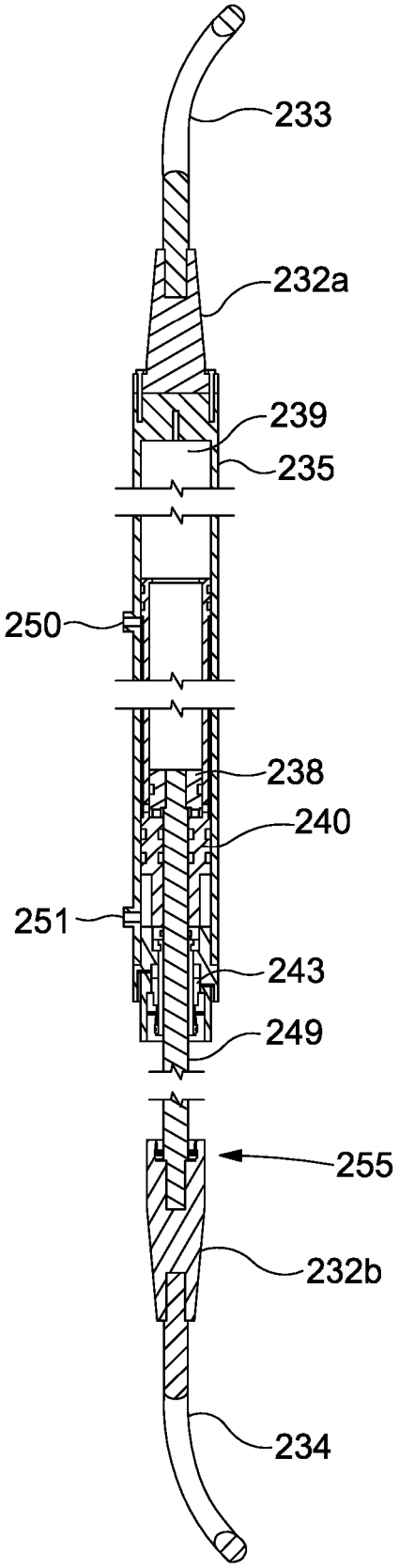
FIG. 7C is a longitudinal cross-sectional view of a constant tension bail shown in a full stroke position, according to an embodiment of the present invention.

When the second piston 240 reaches the end stop position as shown in FIG. 7C, control may be lost, and the landing string 1 may be severed if, the tensile force exerted on the landing string 1 exceeds the tensile failure limit of the landing string 1. If this happens, the constant tension bail 231 may act as a shock absorber, breaking the upward movement of the landing string 1 as it tries to eject out from the well bore. In addition, the constant tension bail may start to close, going back to its original normal operational stroke range. In this manner, the constant tension bail system may prevent the severed landing string from falling on the deck of the rig floor.

According to an embodiment of the invention accumulators 247 and 248 may provide same pressure to both chambers 241 and 242. However, employing a low and a high fluid accumulators is preferred as this way the bails 231 may provide a two-step tension release mechanism for releasing the tension exerted on the landing string 1 in an emergency situation.

Figure 8:
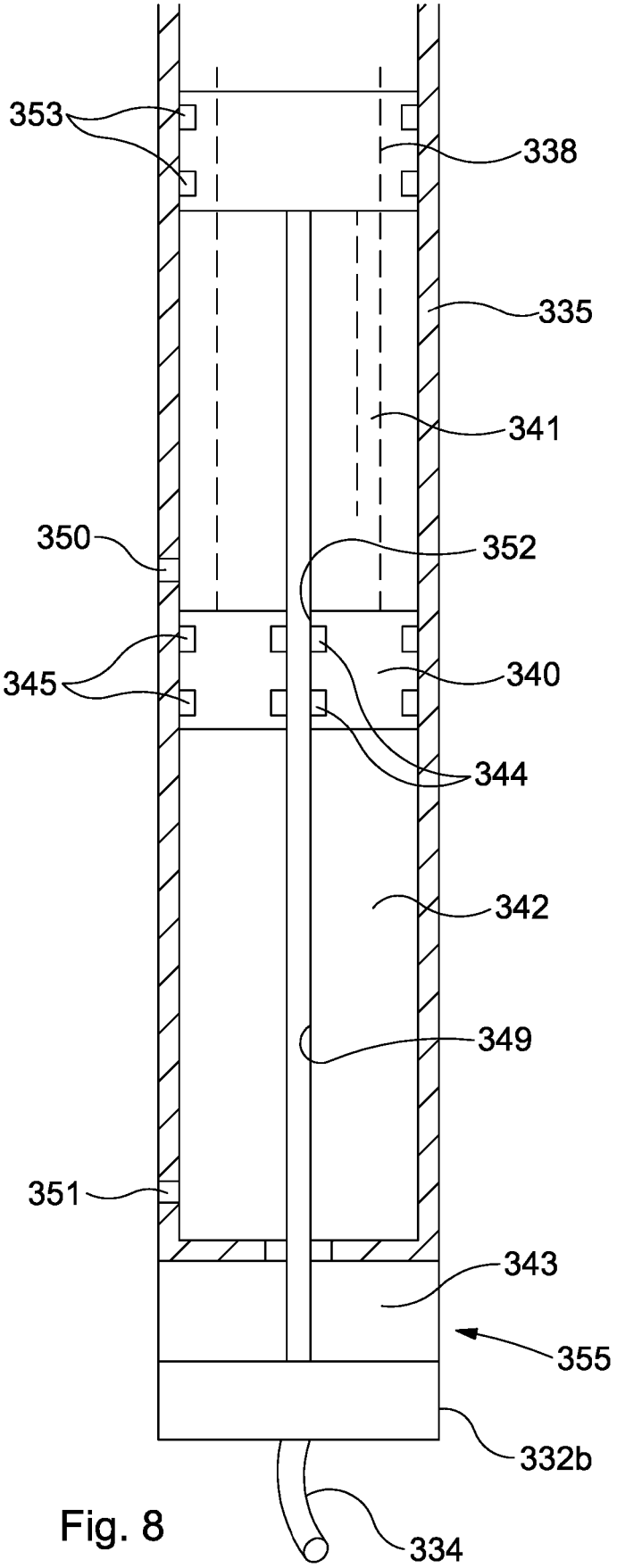
FIG. 8 shows a constant tension bail, according to a different embodiment of the present invention.

Referring now to FIG. 8 another embodiment of a constant tension bail 331 is provided. For ease of reference similar features between this embodiment and the embodiment of FIGS. 7A to 7C are referred to with similar numerals augmented by 100. Thus, bail 331 comprises a housing 332 defined by a cylinder 335 that defines a cylindrical cavity 339 therein. Within the cylindrical cavity 339 there are disposed two pistons, a first piston 338, also referred to as a floating piston and a second piston 340 also referred to as a slow moving piston. The first piston 338 is connected to a telescopic member generally designated with numeral 355. Telescopic member 355 comprises an end connector 332*b* and a piston rod 349. In a normal operating condition, as shown in FIG. 8, the telescopic member 355 is locked to the cylinder 335 via locking mechanism 343.

Piston 340 comprises a central through bore 352 with seals 344 that allow the piston rod 344 to freely move relatively to the piston 340 while preserving pressure isolation between chambers 341 and 342.

Piston 340 also comprises seals 345 disposed on the periphery of the piston rod 349 to seal off the clearance between the piston rod 349 and the interior wall of the cylindrical cavity 339 as piston 349 slidably moves within cylinder 335.

The pistons 338 and 340 define two chambers 341, and 342 within the cylindrical cavity 339. A first chamber 341 is defined between the floating piston 338 and the second piston 340. A second chamber 342 is defined between the second piston 340 and an end 339*a* of the cavity 339.

The first chamber 341 contains a first fluid maintained at a first pressure via a fluid supplied via a first port 350 from a first accumulator (not shown).

The second chamber 342 contains a second fluid maintained at a second pressure via a fluid supplied via a second port 351 from a second accumulator (not shown) in a similar manner as described earlier in relation to the embodiment of FIG. 7A.

Seals 345 disposed on the periphery of piston 349 to preserve pressure isolation for chamber 341 as piston 338 slides within cylinder 335.

Piston rod 349 extends longitudinally along a central axis of the housing 332 from piston 338 through piston 340 through an aperture 354 of the housing and a through bore 355 defined within the locking mechanism to the telescopic member 355. An end connector 332*b* is mounted to the telescopic member 355 for ready connection to a pipe string.

It should be understood that the embodiments described herein are merely exemplary and that various modifications may be made thereto, without departing from the scope of the present invention.

What is claimed is:

1. A retainer system comprising:

a retainer device comprising a housing mountable to a platform or vessel, the housing defining a through bore for receiving a pipe string;

a safety sleeve extending through the through bore of the housing, and being radially fixed relative to the housing, the safety sleeve defining a lower end; and a stop arrangement mountable on the pipe string such that the stop arrangement is located below the lower end of the safety sleeve;

wherein, in use, the fixed safety sleeve and stop arrangement are configured together such that engagement between the lower end of the safety sleeve and the stop arrangement limits relative upward movement between the housing and the pipe string in the event that the pipe string is severed, so as to prevent the pipe string from ejecting out of a through bore of the housing; and wherein the safety sleeve comprises an impact absorption section aligned to engage the stop arrangement of the pipe string.

2. The retainer system as in claim 1, wherein the retainer system is connectable to one or more heave compensation systems connected with the platform or vessel.

3. The retainer system as in claim 1, wherein the retainer system is installed above or below a rig floor of a platform or vessel.

4. The retainer system as in claim 1, wherein the retainer device is mountable to the platform or vessel so that the through bore of the housing is aligned with a through bore of a rotary table installed on a rig floor of a platform or vessel.

5. The retainer system as in claim 1, wherein the through bore of the housing permits the pipe string to be deployed freely therethrough and for the safety sleeve to be mounted therein.

6. The retainer system as in claim 1, wherein the safety sleeve is releasably fastened to the housing.

7. The retainer system as in claim 1, wherein the safety sleeve is or comprises an insert adapted to be positioned within a corresponding pocket of the housing.

8. The retainer system as in claim 1, wherein the safety sleeve comprises a cylindrical tubular body that fits around the pipe string.

9. The retainer system as in claim 1, wherein the safety sleeve is secured within the housing by an annular packer urged against the safety sleeve.

10. The retainer system as in claim 1, wherein the safety sleeve defines the shape of an annular ring positioned within the housing in close proximity with the pipe string so that the annular ring is capable of engaging the stop arrangement of the pipe string.

11. The retainer system as in claim 1, wherein the impact absorption section comprises a dampening mechanism.

12. The retainer system as in claim 1, comprising a seal for sealing between the safety sleeve and the housing.

13. The retainer system as in claim 1, wherein the stop arrangement comprises a structure mountable on an outer surface of the pipe string.

14. The retainer system as in claim 1, wherein the stop arrangement comprises a dampening portion and/or a dampening mechanism.

15. A retainer system comprising:

a retainer device comprising a housing mountable to a platform or vessel, the housing defining a through bore for receiving a pipe string;

a safety sleeve extending through the through bore of the housing, and being radially fixed relative to the housing, the safety sleeve defining a lower end;

a stop arrangement mountable on the pipe string such that the stop arrangement is located below the lower end of the safety sleeve;

wherein, in use, the fixed safety sleeve and stop arrangement are configured together such that engagement between the lower end of the safety sleeve and the stop arrangement limits relative upward movement between the housing and the pipe string in the event that the pipe string is severed, so as to prevent the pipe string from ejecting out of a through bore of the housing; and a dynamic sealing arrangement to be positioned between the safety sleeve and the pipe string.

16. A retainer system comprising:

a retainer device comprising a housing mountable to a platform or vessel, the housing defining a through bore for receiving a pipe string;

a safety sleeve extending through the through bore of the housing, and being radially fixed relative to the housing, the safety sleeve defining a lower end; and a stop arrangement mountable on the pipe string such that the stop arrangement is located below the lower end of the safety sleeve;

wherein, in use, the fixed safety sleeve and stop arrangement are configured together such that engagement between the lower end of the safety sleeve and the stop arrangement limits relative upward movement between the housing and the pipe string in the event that the pipe string is severed, so as to prevent the pipe string from ejecting out of a through bore of the housing;

wherein the safety sleeve slidably fits around the pipe string, allowing a clearance between the pipe string and the safety sleeve, the clearance between the pipe string and the safety sleeve being adjustable.

17. A retainer system comprising:

a retainer device comprising a housing mountable to a platform or vessel, the housing defining a through bore for receiving a pipe string;

a safety sleeve extending through the through bore of the housing, and being radially fixed relative to the housing, the safety sleeve defining a lower end; and a stop arrangement mountable on the pipe string such that the stop arrangement is located below the lower end of the safety sleeve;

wherein, in use, the fixed safety sleeve and stop arrangement are configured together such that engagement between the lower end of the safety sleeve and the stop arrangement limits relative upward movement between the housing and the pipe string in the event that the pipe string is severed, so as to prevent the pipe string from ejecting out of a through bore of the housing;

wherein the stop arrangement comprises a continuous annular structure.

* * * * *